United States Patent [19]

Painter

[11] 4,430,132

[45] Feb. 7, 1984

[54] DESENSITIZING EXPLOSIVES

[75] Inventor: Alfred E. Painter, Bridgewater, England

[73] Assignee: The Secretary of State for Defence in Her Britannic Majesty's Government of the United Kingdom of Great Britain and Northern Ireland, London, England

[21] Appl. No.: 173,396

[22] Filed: Jul. 29, 1980

Related U.S. Application Data

[63] Continuation of Ser. No. 903,838, May 8, 1979, abandoned.

[30] Foreign Application Priority Data

May 11, 1977 [GB] United Kingdom ..... 19868/77

[51] Int. Cl.[3] ..... C06B 45/22

[52] U.S. Cl. ..... 149/109.6; 149/7; 149/11; 149/92; 149/93; 264/3 C; 427/216

[58] Field of Search ..... 264/2 C; 149/7, 11, 149/109.6, 92, 93; 427/216

[56] References Cited

U.S. PATENT DOCUMENTS

| | | | |
|---|---|---|---|
| 2,719,153 | 9/1955 | Schulz | 149/11 |
| 2,867,647 | 1/1959 | Gow et al. | 149/11 |
| 3,348,986 | 10/1967 | Sauer | 149/11 |
| 3,403,061 | 9/1968 | McDonald | 149/11 |
| 3,455,749 | 7/1969 | Gow | 149/11 |
| 3,466,204 | 9/1969 | Gow | 149/11 |
| 3,544,360 | 12/1970 | Gardner | 149/11 |
| 3,740,278 | 6/1973 | Sakreis et al. | 149/11 |
| 3,740,279 | 6/1973 | Levering et al. | 149/19.91 |
| 4,092,187 | 5/1978 | Hildebrant et al. | 149/11 |
| 4,097,317 | 6/1978 | Schnur et al. | 149/7 |

FOREIGN PATENT DOCUMENTS 574271 12/1945 United Kingdom .

*Primary Examiner*—Edward A. Miller

*Attorney, Agent, or Firm*—Stevens, Davis, Miller & Mosher

[57] ABSTRACT

A process for desensitizing sensitive explosives materials such as RDX or HMX involves stirring a paste of the explosives material in a liquid medium, usually water, with a wax which will soften below the safe decomposition temperature of the explosives material, heating the mixture to drive off the liquid and soften the wax which is then coated onto the explosives material as the liquid evaporates. On cooling, explosive material particles substantially entirely encapsulated in wax are obtained. When warm or after cooling, aluminum powder can be mixed with the desensitized material. As little as 1% of added wax can improve the F of I of RDX from 73 to around 100 and the wax coating is quite stable even when the explosive is pressed, e.g. when making charges.

10 Claims, No Drawings

DESENSITIZING EXPLOSIVES

This is a continuation of application Ser. No. 903,838 filed May 8, 1979, now abandoned.

The present invention relates to a method of preparing a desensitized explosives composition by treatment of the explosives material with a wax.

Heretofore waxes have been incorporated with water-insoluble explosives such as RDX, by suspending the explosives material in two to three times its weight of water, heating the water to a temperature at which the wax will melt (usually about 95° C.), adding the wax in lump or flake form and stirring the whole vigorously to distribute the molten wax globules through the suspension. (The water acts inter alia to desensitize the explosives material whilst the process is being carried out). On cooling the suspension the wax solidifies on the explosives material to produce a granular mass of explosive/wax which can be filtered off and dried. This product may be described as being a loose conglomeration of explosives particles and solidified wax in which some particles are enveloped in lumps of wax whilst other particles of the explosives material are not coated or are even stuck to the outside of solidified wax lumps. Thus considerable areas of the crystal surfaces are left exposed. As a result the wax has only a limited effect as a desensitizer, even when used in very large amounts in such a composition. For example, with a conventionally produced RDX-wax composition, as much as 12% by weight of wax is required to give a Figure of Insensitiveness, (a measure of the insensitivity of the explosive to detonation under controlled conditions) of 110, which although an improvement upon the typical F of I for conventionally produced, dry RDX of 73, is nevertheless inferior to the figure obtainable for a completely coated explosives material using less than 5% of wax. Furthermore when the conventionally produced material is only lightly pressed together, and even during normal handling, more uncoated RDX crystal surfaces are exposed, so that the material then shows lower values of the F of I. This is an important consideration where the explosives material is to be pressed to form charges.

It is now appreciated that in order to form a continuous coating of wax on particles of explosives material it is necessary to remove all the water from the explosives/water mixture before the wax can completely coat the particles.

According to the present invention, a method for the preparation of a wax-desensitized explosives composition comprises the steps of:

(1) adding to a treatment vessel, with stirring (a) a paste of an explosives material in a liquid medium effective to desensitize the explosives material but which is not a solvent for the explosives material, and (b) a wax, the softening point of the wax being below the safe decomposition temperature of the explosives material;

(2) heating the mixture obtained in step (1), while stirring, until the liquid medium has evaporated off from the surfaces of the explosives material and the wax has at least softened and has become coated onto said surfaces; and (3) cooling the mixture under stirring.

The invention also provides a desentitized explosives material comprising particles of the explosives material the surfaces of which particles are substantially entirely uniformly coated with a wax having a softening point of less than the safe decomposition temperature of the explosives material.

A preferred explosives material which may be treated according to the process of this invention is RDX, though the process may be applied to other particulate explosives such as HMX, PETN, DATNB or Picrite.

The liquid medium is preferably water, but any desensitizing liquid, in which the explosives material is insoluble may be suitable. Examples of such liquids are toluene, chlorobenzene or a petroleum fraction.

The method of the present invention provides desensitized explosives compositions with sensitivities which are approximately equivalent or even superior to those of the conventional compositions, whilst incorporating substantially smaller amounts, even down to as little as 1% by weight of the composition, of wax. According to requirements however as much as 12% of wax may be used, for example where an enhanced degree of insensitiveness of the explosives material is desired.

The wax may be any wax which softens below the safe decomposition temperature of the explosives material. By 'safe decomposition temperature' is meant the upper temperature limit to which a given explosives material may be subjected without the occurrence of unacceptable decomposition of the explosives material or unacceptable danger of sudden decomposition occurring. Such temperatures in relation to any given explosive are well understood by those skilled in the art. The wax need not be one which has a melting point below the safe decomposition temperature of the explosives material, though the coating process takes place more readily if the wax is actually in the liquid state at this stage. However, the effectiveness of the wax coating is apparently not affected by the exact state of the wax so long as it is soft enough to be smeared onto the explosives material.

It may be appreciated that as the stirred suspension of the explosives material with wax in the liquid medium is heated according to the method of the invention, one of three possible situations may occur. Thus the wax will soften either before the liquid medium commences to evaporate, or whilst the liquid medium is evaporating, or after the liquid medium has evaporated off. In the first and second situations the liquid medium which is present will serve to desensitize the explosive throughout, whilst in the third situation the unmolten wax has to be effective to desensitize the explosive after the liquid medium has evaporated off and for this purpose the wax is preferably in a relatively finely divided form. However, a number of conflicting factors affect the desirable particle size of the wax amongst which are the temperature at which the wax and the explosive material are to be heated together in the absence of liquid medium if at all, the relative amounts of wax and explosives material, the state of subdivision of the explosives material and its dry sensitivity, and the materials of which the mixing vessel are made. The factors affecting the choice of suitable particle size for the wax in any given situation will be readily apparent to those skilled in the art, but by way of illustration it may be said that a wax with particle size in the range of 200–250 microns is suitable for producing a wax coated RDX composition containing 1% wax, the RDX having a similar particle size. The wax may be coarser in size where a greater proportion of wax is used in such a mixture, or where the wax melts at a temperature below the boiling point of the liquid medium. Indeed in this circumstance it is even possible to use wax in the form of lumps though in this case the mixture of explosives material, liquid medium and wax will have to be stirred vigorously for a long enough period to ensure that the wax is fully molten and completely distributed in the mixture before the liquid medium is evaporated off. The relationship between the melting point of the wax and the boiling point of the liquid medium will of course be affected by the pressure at which the process is conducted. The process can usefully be carried out at either ambient or reduced pressure, and in the latter case there is a reduction in the heat input which is needed to evaporate off the liquid medium. Also operation at reduced pressure may permit a liquid to be used which has a normal boiling point close to or exceeding the safe decomposition temperature of the explosives material by reducing its boiling point.

According to a further aspect of the invention, the composition may also include other conventional ingredients. For example aluminium powder may be conveniently added in an amount of up to 50% by weight of the composition. A suitable composition comprises:

explosive 66½%; wax 3½% and Al powder 30% (all by weight)

Although other forms of aluminium may be used, 'blown' aluminium is the preferred form, suitably blown aluminium having a specific surface area of the order of 2000 to 6000 $cm^2/cm^3$.

When aluminum powder is to be incorporated in the composition, it is added to the mixture in the treatment vessel after all the water has been evaporated off and after the wax has been melted and coated onto the explosives material, ie after step (2). Therefore the aluminium powder is conveniently stirred into the hot explosive/wax mixture and the whole then cooled (as described in step (3) of the process). In this case the aluminium powder is coated onto the wax-encapsulated explosive particles when the coating is tacky and is itself also coated with wax. Probably because of the high surface area of the aluminium powder it helps to prevent the particles from aggregating on cooling by virtue of the wax being spread only thinly on the particle surfaces. It is necessary to continue stirring the material as it cools to break up any incipient aggregates, especially where the material contains no aluminium powder. When prepared in this way, the product (with or without aluminium powder admixed) is a free-flowing powder.

To aid wetting of the explosives material by the molten wax it has been found useful to add a wetting agent to the explosive paste/wax mixture. Suitable wetting agents are fatty acid esters, for example penta-erythritol di-oleate, or sulphate esters, for example Teepol L, either of which materials may conveniently be used in an amount of up to 0.35%, preferably about 0.1%, by weight of the explosives material.

In the first stage of the process of the invention, viz preparation of the explosive material-liquid medium-wax mixture, it has been found convenient to prepare the explosive material initially in the form of a paste in the liquid medium and to introduce this first into the treatment vessel. Stirring of this paste in the treatment vessel then ensures homogenization of the particle size distribution of the explosives material, while the presence of the liquid medium (in an amount of from 20 to 30%, typically) provides for adequate desensitization of the explosive during the process up to the time when the wax coating is formed on the explosives particles (for a wax which softens below the boiling point of the liquid medium at the relevent ambient pressure) or until the solid wax is sufficiently distributed to effect the desensitization itself (in the case of a wax which softens only above the boiling point of the liquid medium at the relevant ambient pressure). The explosive may also be desensitized for the purpose of handling by the addition to the slurry of a small amount of the wetting agent referred to above.

When the mixture has been formed (step (1)) it is heated and stirred so that as the temperature rises the wax is distributed among the particles of explosive material in the paste. If the wax softens below the boiling point of the liquid medium at the relevant ambient pressure it will coat onto the explosives material progressively as the liquid medium is being evaporated off from the mixture. The explosives material will thus be effectively desensitized throughout the whole procedure. If the wax only softens above the boiling point of the liquid medium at the relevant ambient pressure then the liquid medium will evaporate before the wax is soft and able to start coating the explosives material and in this state the solid wax will effect desensitization of the explosives material itself. For this purpose it is preferable to use a finely divided wax as indicated previously.

In either case the wax should become sufficiently fluid in order to form a good continuous coating on the explosives material and it is therefore generally advantageous to heat the wax well above its melting point to put it in a sufficiently fluid state. However good results may also be obtained with waxes which soften substantially at temperatures below the safe decomposition temperature of the explosive, but have melting points above that temperature.

To cool the mixture in the final stage of the process a controlled flow of cooling water conveniently is admitted to a jacket surrounding the treatment vessel.

As explained hereinbefore the process of the present invention may be used with any wax which has a softening point not exceeding the safe decomposition temperature of the explosives material. For waxes having a higher softening point than the decomposition temperature of the chosen explosives material the method of treatment disclosed and claimed in copending application No. 173,395/77 may usefully be employed. Also in some cases safety margins conventionally allowed in manufacturing plants may make it unacceptable to operate the present process at a temperature which too closely approaches the safe decomposition temperature of the explosives material and in such a case again the method of the copending application may be usefully employed. For further details of this method reference should be made to the said application.

To further illustrate the process of the present invention, some examples of the practice thereof are now given.

EXAMPLE 1

(a) About 1200 g of wet Grade I RDX (equivalent dry weight 950.0 g) were placed in a cold mixing pan and 1.0 g of pentaerythritol dioleate stirred in for about 5 minutes. 50 g (5%) of milled wax 8, all passing a 60 BS sieve (250 micron aperture), were then added to the pan and the whole mixed cold for 15 minutes. (Wax 8 is a composition of 15% low density polyethylene plus 85% wax 6, which is a microcrystalline hydrocarbon wax obtained from the still bottoms of crude petroleum distillation and freed from oil by solvent extraction. Wax 6 has a congealing point of 80°-86° C. and Wax 8 has a dropping point between 92° and 95° C. The polyethylene used is typically Alkathene 20 (Trade Mark) produced by ICI Ltd.) After cold mixing in of the wax, steam was admitted to the pan jacket and the contents treated under atmospheric pressure with continuous stirring. After 30 minutes all the water had been evaporated and heating and stirring were continued for a further 15 minutes to make the wax highly fluid.

(b) The steam supply was disconnected from the mixing pan and the mixture of wax and explosives material left to cool, with stirring, for 15 minutes. Cold water was then passed through the pan jacket and the mix cooled to room temperature with continuous stirring (about 20 minutes). The stirrer was then stopped and the mix discharged, the product being passed through a 10 mesh BS sieve (1676 microns aperture).

The product when tested showed an F of I of 125 (median value determined from 50 caps by the Rotter method) compared with 73 for the crude RDX.

EXAMPLE 2

The procedure of Example 1 stage (a) was repeated and then there was added to the mixture of explosives material and wax, with stirring, 430.0 g (30% of the total amount) of aluminium powder over a period of 5 to 10 minutes. Heating and stirring were then continued for 30 minutes before the steam supply was disconnected from the pan and the mix allowed to cool with stirring, for 15 minutes. After this cold water was passed through the pan jacket and the mix cooled to room temperature, still with continuous stirring. This cooling occupied about 15 to 20 minutes, after which the stirrer was stopped and the mix discharged and passed through a 10 mesh BS sieve.

This product when tested under the same conditions as in Example 1 showed an F of I of 123.

EXAMPLE 3

In a laboratory test, a quantity of wet Grade I RDX (95%) was mixed with wax 8 (5% by weight) and the mixture vacuum-dried. Two grades of wax 8 were used, one in which the wax all passed a 60 BS sieve and one in which all the wax passed a 200 BS sieve. The dried mixtures were found to exhibit respective F of I values of 106 and 107. On subsequent heating the wax became fluid and was coated onto the RDX particles to give a product with an F of I of 125. This clearly demonstrates the advantage which is to be gained by fully coating the RDX particles with wax.

Data from the Examples and from other desensitized explosives produced by the treatment process according to this invention is given in the Table, together with comparative data from prior art products. This data clearly illustrates the reduction in sensitivity to detonation of the explosives material which is demonstrated by the explosive material RDX treated according to this invention, using similar amounts of wax to those used conventionally, or alternatively shows that a degree of densensitization which is at least equivalent to that achieved with conventional wax-coating processes, is obtained whilst using far smaller quantities of wax. In the latter case the explosives content of the final mixture is superior to that of the conventionally coated materials, and in general, the stability and reproducibility of the wax coating produced according to the present process is enhanced compared to that of conventionally made products.

A particularly useful product is one in which the wax is a mixture of equal parts of Wax 3 (diacid amide of p-phenylene diamine and stearic acid) and Wax 6. This mixture softens at 90°–95° C. and can be smeared onto an explosives material at this temperature, but does not melt until a temperature of 165° C. is reached and so provides effective desensitization even at high temperatures.

TABLE OF F OF I DATA
(All data are median values based on 50 caps (Rotter method)).

| Weight of RDX % | Wax Type | Wax Weight % | Weight of Al powder (%) | Method of wax coating | F of I value |
|---|---|---|---|---|---|
| 100 | None | — | None | None | 80[a] |
| 100 | None | — | None | None | 73[b] |
| 88 | Wax 8 | 12 | None | Conventional | 110 |
| 91 | Wax 8 | 9 | None | " | 90 |
| 61.6 | Wax 8 | 8.4 | 30[e] | " | 104 |
| 91 | Wax 8[c] | 9 | None | Invention | >200 |
| 95 | Wax 8[d] | 5 | None | " | 125 |
| 95 | Wax 6[c] | 5 | None | " | 130 |
| 99 | Wax 8[c] | 1 | None | " | 93 |
| 99 | Wax 8[d] | 1 | None | " | 107 |
| 99 | Wax 6[c] | 1 | None | " | 98 |
| 63.7 | Wax 8[c] | 6.3 | 30[e] | " | 130 |
| 66.5 | Wax 8[d] | 3.5 | 30[e] | " | 97 |
| 66.5 | Wax 8[d] | 3.5 | 30[f] | " | 123 |

[a]'Standard' value for RDX
[b]Production quality RDX
[c]Wax added in flake form
[d]Wax added in powder form; slurry vacuum dried
[e]Aluminium incorporated cold
[f]Aluminium incorporated hot

I claim:

1. A process for desensitising a particulate explosive with a wax which comprises, (1) stirring a water-insoluble wax, having a softening point below the safe decomposition temperature of the explosive, with a paste of the water-insoluble explosive in an aqueous medium;

(2) heating and stirring the resulting mixture of wax and explosive paste until the water has evaporated from the surfaces of the explosive particles and the wax has at least softened and has become coated onto the surface of the explosive particles; and (3) cooling and stirring the resulting wax-coated explosive particles to below the softening point of the wax until the wax on the explosive particles has solidified.

2. A process according to claim 1, wherein the wax has a melting point below the safe decomposition temperature of the explosive.

3. A process according to claim 1, wherein the paste contains from 20 to 30% by weight of the liquid medium.

4. A process according to claim 1, wherein the wax comprises from 1 to 12% by weight of the desensitized explosive.

5. A process according to claim 1, wherein the mixture of wax and explosive paste also contains a wetting agent.

6. A process according to claim 5, wherein the wetting agent is a fatty acid ester or a sodium alkyl sulphate of a higher fatty alcohol.

7. A process according to claim 6, wherein the wetting agent is present in an amount of about 0.1% by weight of the explosive.

8. A process according to claim 1, wherein the explosive is cyclotrimethylene trinitramine, cyclotetramethylene tetranitramine, pentaerythritol tetranitrate, diamino-trinitrobenzene or nitroguanidine.

9. The process of claim 1, including the additional step of mixing the product of step (2) with an aluminum powder having a specific surface area of between 2000 and 6000 $cm^2/cm^3$, and subsequently performing step (3).

10. The process of claim 1, including the additional step of mixing the product of step (3) with an aluminum powder having a specific surface area of between 2000 and 6000 $cm^2/cm^3$.

* * * * *